US005372628A

United States Patent [19]

Steeghs

[11] Patent Number: 5,372,628

[45] Date of Patent: Dec. 13, 1994

[54] METHOD FOR PRODUCING REDUCIBLE IRON-CONTAINING MATERIAL HAVING LESS CLUSTERING DURING DIRECT REDUCTION AND PRODUCTS THEREOF

[75] Inventor: Harry R. G. Steeghs, Englewood, Colo.

[73] Assignee: Akzo N.V., Arnhem, Netherlands

[21] Appl. No.: 119,775

[22] Filed: Sep. 10, 1993

[51] Int. Cl.[5] ..... C21B 11/00

[52] U.S. Cl. ..... 75/300; 75/443; 75/447

[58] Field of Search ..... 75/447, 443, 300

[56] References Cited

U.S. PATENT DOCUMENTS

| | | | |
|---|---|---|---|
| 3,062,639 | 11/1962 | Sterling | 75/26 |
| 3,341,322 | 9/1967 | Bailey | 75/447 |
| 3,393,066 | 7/1968 | Mayer | 75/447 |
| 3,823,011 | 7/1974 | Sebenik | 75/447 |
| 3,975,182 | 8/1976 | Goetzman | 75/3 |
| 4,042,375 | 8/1977 | Martin et al. | 75/4 |
| 4,288,245 | 9/1981 | Roorda et al. | 75/0.5 R |
| 4,695,315 | 9/1987 | Kortmann et al. | 75/0.5 R |
| 5,000,783 | 3/1991 | Dingeman et al. | 75/321 |

FOREIGN PATENT DOCUMENTS

| | | | |
|---|---|---|---|
| 1193440 | 9/1985 | Canada | 53/10 |
| 207779 | 7/1987 | European Pat. Off. | C21B 13/00 |
| 0225171 | 10/1987 | European Pat. Off. | C22B 1/24 |
| 54-1181A1 | 12/1993 | European Pat. Off. | C22B 1/244 |
| 2061346 | 6/1972 | Germany | C21B 13/00 |

*Primary Examiner*—Peter D. Rosenberg
*Attorney, Agent, or Firm*—Ralph J. Mancini; Louis A. Morris

[57] ABSTRACT

A method for abating the incidence of cluster formation of reducible iron-containing material during the direct reduction of said material is disclosed. The method generally comprises contacting the reducible iron-containing material with a cluster-abating effective amount of a dispersion of a particulate material.

14 Claims, No Drawings

METHOD FOR PRODUCING REDUCIBLE IRON-CONTAINING MATERIAL HAVING LESS CLUSTERING DURING DIRECT REDUCTION AND PRODUCTS THEREOF

BACKGROUND OF THE INVENTION

The current invention relates to a novel process for lowering the incidence of clustering or sticking of reducible iron-containing material during the direct reduction of said material. The process comprises contacting the reducible iron-containing material with a dispersion of certain particulate material(s).

It is a well known technical problem that particulate reducible iron-containing material tends to stick together, forming large clusters or agglomerates during their processing in a direct reduction furnace. These clusters tend to remain intact during treatment in a direct reduction furnace, impeding appropriate flow through the furnace. One possible though unacceptable solution to this problem is lowering the furnace temperature and through put. From the perspective of efficiency alone this solution is not appropriate.

other solutions have been suggested to decrease clustering in a direct reduction furnace while maintaining a high processing rate through the furnace. For example, European Patent Specification No. 207 779 teaches application of a cement coating to the surface of burned iron ore prior to direct reduction in order to prevent agglomeration in the direct reduction furnace. U.S. Pat. No. 3,062,639 discloses a process for treating reducible iron oxide by contacting the iron oxide with a solution comprising an element selected from the group consisting of an alkali metal, an alkaline earth metal, a metal of group V, a metal of group VIB, boron, and silicon. This is intended to prevent clustering in the furnace reduction zone.

In U.S. Pat. No. 3,975,182, a method to produce iron oxide pellets which do not form clusters in a vertical shaft moving bed is disclosed. In that method, a surface coating of lime, limestone or dolomite is formed on iron oxide pellets. The lime-containing material is added in dry form in a balling machine with a spray of a little water to promote adhesion. The pellets are then fired to form a hard coating of calcium ferrite.

However, such above mentioned solutions are not adequate to overcome ore clustering in direct reduction furnaces at the processing rates and conditions currently required.

Accordingly, the development disclosed herein surprisingly lowers the occurrence of clustering of reducible iron-containing material in direct reduction furnaces.

SUMMARY OF THE INVENTION

In one embodiment, the instant invention is a method to lower the incidence of clustering of reducible iron-containing material during the direct reduction of said material, said method comprising contacting the reducible iron-containing material with a cluster-abating effective amount of a dispersion of a particulate material, said particulate material being substantially nonhardening in the presence of water, wherein said contacting occurs prior to said direct reduction.

In another embodiment, the instant invention involves contacting a reducible iron-containing material with a dispersion of certain particulate material(s) by dipping or spraying.

DETAILED DESCRIPTION OF THE INVENTION

The current invention relates generally to solving the problem of clustering of reducible iron-containing material during direct reduction of such material. The method comprises contacting the reducible iron-containing material with a cluster-abating effective amount of at least one of certain particulate materials prior to direct reduction. Such decreased cluster formation fosters more efficient and/or effective operation of the direct reduction furnace by allowing, for example, higher operation temperatures, increased through put, etc.

The reducible iron-containing material of the instant invention may be in any form that is typical for processing through a direct reduction furnace. For nonlimiting example, the reducible iron-containing material may be agglomerated (e.g. pelletized, briquetted, granulated, etc.) and/or in natural virgin form (e.g. lump ore, fine ore, concentrated ore, etc.)

In one embodiment, the reducible iron-containing material is in the form of pellets comprising binder and/or other typical additives employed in iron ore pellet formation. For nonlimiting example, such binders may be a clay, such as bentonite, montmorillionite, etc.; a water-soluble natural polymer, such as guar gum, starch, etc.; a modified natural polymer, such as guar derivatives (e.g. hydroxypropyl guar, carboxymethyl guar), modified starch (e.g., anionic starch, cationic starch), starch derivatives (e.g., dextrin) and cellulose derivatives (e.g., hydroxyethyl cellulose, carboxymethyl cellulose, hydroxypropyl cellulose, methyl cellulose, etc.); and/or a synthetic polymer (e.g., polyacrylamides, polyacrylates, polyacrylamide-polyacrylate copolymers, polyethylene oxides, etc.). Such binders my be used alone or in combination with each other, and with or without inorganic compounds including but not limited to activators such as alkali carbonates, phosphates, citrates, etc.

The binder may also be supplied in the form of a binder composition. A binder composition is often comprised of a binder or modified binder containing by-products of the binder formation as well as desired additives.

A particularly preferred binder or binder composition of the instant invention is comprised of an alkali metal salt of carboxymethyl cellulose (CMC). The binder or binder composition of an alkali metal salt of CMC may contain as by-products, for example, sodium chloride and sodium glycolate, as well as other polysaccharides or synthetic water-soluble polymers and other "inorganic salts" (for nonlimiting example sodium carbonate, sodium citrate, sodium bicarbonate, sodium phosphate and the like).

A series of commercially available binders containing sodium carboxymethyl cellulose especially useful in the present invention is marketed by Dreeland, Inc. of Denver, Colo., USA and Akzo Chemicals of Amersfoort, the Netherlands, under the trademark Peridur.

As typical composition additives may be mentioned, by non limiting example, flux (e.g., limestone, dolomite etc.), minerals to improve metallurgical properties of the pellets (e.g. olivine, serpentine, magnesium, etc.), caustic and coke.

Typical binders and additives, as well as the method of use of binders and additives are well known in the relevant art and thus need no detailed explanation here. See, for nonlimiting example, U.S. Pat. Nos. 5,000,783 and 4,288,245.

As used herein, "dispersion" means any distribution or mixture of fine, finely divided and/or powdered solid material in a liquid medium. The similar terms "slurry", "suspension", etc. are also included in the term "dispersion".

As used herein, a "particulate material being substantially nonhardening in the presence of water" is a divided, finely divided and/or powdered material capable of forming a dispersion in a liquid medium and is substantially inert to hardening when mixed with water, unlike, for nonlimiting example, portland cement. In a preferred embodiment, the particulate material is comprised of aluminum or an aluminum compound, such as, for nonlimiting example, bauxite and bentonite. The size of the particulate material in the dispersions of the current invention is determined by the type of particulate material and its ability to form a dispersion in the medium selected. Thus, it may be said that, in general, the average size of the particulate material will be in the range of, for nonlimiting example, below about 1 millimeter, typically in the range of about 50 microns to about 150 microns, and may be as low as 1.5 microns. However, as explained above, the size of the particulate material will vary depending on many factors, but is well known to a person skilled in the art.

In carrying out the method of the instant invention, various techniques may be used to contact the reducible iron-containing material with the particulate material. The methods preferably employed involve forming a dispersion (slurry, suspension etc.) of the particulate material. Such dispersions, suspensions and/or slurries are formed with the aid of a liquid medium, for nonlimiting example, water, organic solvents, solutions/dispersions of water-soluble/water-dispersible polymer(s) in water (e.g. to enhance dispersion), etc. The reducible iron-containing material (preferably, but not necessarily already in the form of pellets) is then contacted with the resulting dispersion, suspension and/or slurry. Such contacting may take place by, for example, spraying and/or dipping, and further, it may be partial or complete. For example, if such contacting is accomplished by dipping, the reducible iron-containing material may be partially dipped or completely immersed.

In any event, the reducible iron-containing material may be contacted with a dispersion of particulate material(s) described herein at any time prior to direct reduction. For example, if the reducible iron-containing material is provided in the form of pellets, the dispersion may be applied to either green or fired pellets.

The "cluster-abating effective amount" will vary depending upon numerous factors known to the skilled artisan. Such factors include, but are not limited to, the type of reducible iron-containing material, as well as its physical form, moisture content, etc., the specific particulate material employed, as well as its form and other physical characteristics, the dispersion medium (e.g. water alcohol, etc.), the concentration of particulate material in the dispersion medium, the operating conditions of the direct reduction furnace, etc. Though not limiting, a cluster-abating effective amount of a particulate material will typically be above about 0.01 wt. % based on the dry weight of the reducible iron-containing material after contact with the particulate material. Preferably, the particulate material is present in the range of about 0.01 wt. % to about 2 wt. %. In the case that bauxite is employed as a particulate material, a typical aqueous dispersion will be in the range of about 5% to about 40%. Depending on contact conditions, the bauxite will be present on the reducible iron-containing material in the range of about 0.01 wt. % to about 1 wt. %. If bentonite is used as a particulate material, a typical aqueous dispersion will be in the range of about 5% to about 15%. Again depending on contact conditions, the bentonite will be present on the reducible iron-containing material containing in the range of about 0.1 wt. % to about 2 wt. %.

The invention is further described by the following nonlimiting examples.

EXAMPLES

Reducible iron-containing pellets were prepared from iron ore concentrate admixed with 0.2 wt. % bentonite, 1.5 wt. % dolomite and 0.06 wt. % Peridur 230 binder (a sodium carboxymethyl cellulose-containing binder available from Dreeland, Inc. of Denver, Colo., USA and Akzo Chemicals of Amersfoort, the Netherlands). Procedures for such iron ore pellet formation are well known to the skilled artisan, as, for example, demonstrated by European Patent Application EP 0 541 181 A1, EP 2 225 171 A2, U.S. Pat. No. 4,288,245, and the references cited therein. Accordingly, the detailed procedure need not be recited here. The formed green ball pellets were fired at about 1300° C.

Portions of the fired pellets were then separately contacted with dispersions of various particulate materials. For each particulate material dispersion tested, a sample of 2 kg of the above described fired pellets was dipped in a 10% aqueous dispersion of the relevant particulate material for approximately 2 seconds, then dried at 105° C., leaving a deposit of about 0.05 wt. %. As indicated on Table I, bauxite, bentonite and Portland cement were tested as particulate materials. Also, an additional sample of 2 kg of the above described fired pellets, identified as "Control", was subjected to no further treatment prior to direct reduction.

Each pellet sample was separately subjected to a reduction temperature of 850° C.

The reduced pellets were then subjected first to a "sticking tendency" test (to determine their tendency to cluster) and then to crushing strength test. The "sticking tendency" test was performed by dropping the reduced pellets from a height of one (1) meter. After each multiple of 5 drops (i.e., 5, 10, 15 and 20) the "clustered" pellets (a group of two or more pellets stuck together) and the "unclustered" pellets (single pellets) were weighed. The unclustered pellets were removed before the next series of 5 drops.

The crushing strength was determined using the procedure of ISO 4700, with the exception that ISO 4700 prescribes oxidized pellets and here reduced pellets were tested.

The results are reported in Table I.

TABLE I

| Properties of Treated Iron Ore Pellets | | | | |
|---|---|---|---|---|
| | Control | Portland Cement | Bauxite | Bentonite |
| Chemical analysis | | | | |
| Fe (total) | 67.43 | n.d. | 67.29 | 67.45 |
| FeO | 0.90 | n.d. | 0.90 | 0.83 |
| $SiO_2$ | 2.08 | n.d. | 1.99 | 2.42 |

TABLE I-continued

| Properties of Treated Iron Ore Pellets | | | | |
|---|---|---|---|---|
| | Control | Portland Cement | Bauxite | Bentonite |
| $Al_2O_3$ | 0.31 | n.d. | 0.35 | 0.43 |
| CaO | 0.57 | n.d. | 0.56 | 0.55 |
| MgO | 0.37 | n.d. | 0.40 | 0.39 |
| P | 0.012 | n.d. | 0.011 | 0.012 |
| S | <0.01 | n.d. | n.d. | n.d. |
| $Na_2O$ | 0.029 | n.d. | n.d. | 0.056 |
| $K_2$ | 0.015 | n.d. | n.d. | 0.023 |
| Mn | 0.030 | n.d. | 0.04 | 0.020 |
| $TiO_2$ | 0.080 | n.d. | 0.050 | 0.070 |
| Clustering % of clustered pellets after | | | | |
| 5 drops (%) | 78.3 | 25.1 | 0 | 0 |
| 10 drops (%) | 45.1 | 2.8 | 0 | 0 |
| 15 drops (%) | 29.8 | 0 | 0 | 0 |
| 20 drops (%) | 20.5 | 0 | 0 | 0 |
| Crushing strength after reduction | | | | |
| average (daN/P) | 36 | 58 | 41 | 51 |
| std. dev. (daN/P) | 16 | 19 | 15 | 20 |
| min. value (daN/P) | 10 | 20 | 10 | 15 |
| max. value (daN/P) | 90 | 100 | 70 | 100 |
| Chemistry | | | | |
| Fe (total) (%) | 93.8 | 93.4 | 93.2 | 91.9 |
| Fe (metallic) (%) | 90.0 | 88.4 | 87.8 | 89.5 |
| metallization (%) | 96.0 | 94.7 | 94.2 | 97.4 |

The foregoing examples have been presented to provide an enabling disclosure of the current invention and to illustrate the surprising and unexpected superiority in view of known technology. Such examples are not intended to unduly restrict the scope and spirit of the following claims.

We claim:

1. A method to lower the incidence of clustering of reducible iron-containing agglomerates during the direct reduction of the iron in said agglomerates, said method comprising contacting the agglomerates with a cluster-abating effective amount of a dispersion of a particulate material, said particulate material being substantially nonhardening in the presence of water, said contacting occurring prior to direct reduction.

2. The method of claim 1 wherein said particulate material comprises aluminum.

3. The method of claim 2 wherein the aluminum is provided in the form of bentonite.

4. The method of claim 2 wherein the aluminum is provided in the form of bauxite.

5. The method of claim 1 wherein said dispersion is a slurry.

6. The method of claim 1 wherein said contacting is accomplished by spraying.

7. The method of claim 1 wherein said contacting is accomplished by dipping.

8. The method of claim 1 wherein said reducible iron-containing agglomerates comprise particulate iron ore and a binder.

9. The reducible iron-containing agglomerates produced by the method of claim 1.

10. The reducible iron-containing agglomerate of claim 9 wherein the particulate material deposited by dispersion contact is about 0.01 to about 2 wt. % of the iron ore-containing agglomerate.

11. A method to lower the incidence of clustering of reducible iron-containing pellets during the direct reduction of said pellets, said method comprising contacting the pellets with a cluster-abating effective amount of a dispersion of a particulate material which is substantially nonhardening in the presence of water, said contacting occurring prior to direct reduction.

12. The method of claim 11 wherein said particulate material comprises aluminum.

13. The method of claim 11 wherein said particulate material is selected from the group consisting of bentonite, bauxite and mixtures thereof.

14. The method of claim 11 wherein said contacting is accomplished by a contacting method selected from dipping or spraying.

* * * * *

US005372628C1

(12) EX PARTE REEXAMINATION CERTIFICATE (4944th)

United States Patent

Steeghs

(10) Number: US 5,372,628 C1

(45) Certificate Issued: Jun. 8, 2004

(54) METHOD FOR PRODUCING REDUCIBLE IRON-CONTAINING MATERIAL HAVING LESS CLUSTERING DURING DIRECT REDUCTION AND PRODUCTS THEREOF

(75) Inventor: Harry R. G. Steeghs, Englewood, CO (US)

(73) Assignee: Akzo N.V., Arnhem (NL)

Reexamination Request:
No. 90/005,602, Dec. 30, 1999

Reexamination Certificate for:

| | |
|---|---|
| Patent No.: | **5,372,628** |
| Issued: | **Dec. 13, 1994** |
| Appl. No.: | **08/119,775** |
| Filed: | **Sep. 10, 1993** |

(51) Int. Cl.[7] ..... C21B 11/00

(52) U.S. Cl. ..... 75/300; 75/443; 75/447

(58) Field of Search ..... 75/300, 443, 447

(56) References Cited

U.S. PATENT DOCUMENTS

| | | | | |
|---|---|---|---|---|
| 2,799,572 A | * | 7/1957 | Holt et al. | 75/443 |
| 3,062,639 A | * | 11/1962 | Sterling | 75/26 |
| 3,341,322 A | | 9/1967 | Bailey | |
| 3,393,066 A | * | 7/1968 | Mayer | 75/447 |
| 3,549,352 A | | 12/1970 | Mayer | |
| 3,615,352 A | | 10/1971 | Mayer | |
| 3,823,011 A | * | 7/1974 | Sebenik | 75/447 |
| 3,957,486 A | | 5/1976 | Sandoval et al. | |
| 3,975,182 A | | 8/1976 | Goetzman | |
| 4,042,375 A | * | 8/1977 | Martin et al. | 75/4 |
| 4,288,245 A | * | 9/1981 | Roorda et al. | 75/0.5 R |
| 4,695,315 A | * | 9/1987 | Kortmann et al. | 75/0.5 R |
| 5,000,783 A | * | 3/1991 | Dingeman et al. | 75/321 |
| 5,181,954 A | | 1/1993 | Berrun-Castanon et al. | |

FOREIGN PATENT DOCUMENTS

| | | | |
|---|---|---|---|
| CA | 1193440 | * | 9/1985 |
| DE | 2 061 346 | | 6/1972 |
| EP | 0225171 | * | 10/1987 |
| EP | 0 207 779 | | 3/1990 |
| EP | 54-1181 A1 | * | 12/1993 |

OTHER PUBLICATIONS

J.F. Gransden and J.S. Sheasby, The sticking of iron ore during reduction by hydrogen in a fluidized bed, Canadian Metallurgical Quarterly, vol. 13, No. 4 (Dec. 1974) pp. 649–656.

S.Y. Ezz, Gaseous Reduction of Fine Iron Ores in the Fluidized State, Transactions of the Metallurgical Society of AIME, vol. 218 (Aug. 1960), pp. 709–714.

G.L. Osberg and T.A. Tweddle, Reduction Of An Iron Ore Concentrate With Hydrogen In A Screen–Packed Fluidized Bed, I&EC Process Design and Development, vol. 5, No. 1 (Jan. 1966), pp. 87–90.

Periodic Table of Elements, CRC Handbook of Chemistry and Physics, 74th Edit., CRC Press, Inc. Dec. 1994.

Merriman, "A Dictionary of Metallurgy" pp16 and 17, Jun. 1959.*

CAMP–ISIJ Effects of Oxides Coating and Gaseous Sulfur on Fluidized Bed Reduction Of Iron Ores, Nagoya Institute Of Technology, Shoji Hayashi, Satoshi Sawai, Yoshiaki Igychi, vol. 4 (Dec. 1991)—1157. Patent Owners Translation attached.

Current Advances in Materials and Processes, Hayashi, et al., Zairyou to process, 3 (Dec. 1990), 125.

Current Advances in Materials and Processes, Hayashi, et al., Zairyou to process, 3 (Dec. 1990), 1082.

Current Advances in Materials and Processes, Miyagawa, et al.. Zairyou to process, 2 (Dec. 1989), 118.

Prevention of Sticking During Fluidized Bed Reduction Of Fine Iron Ores Under Controlled Sulfur Potential, Dr. Shoji Hayashi and Dr. Yoshiaki Iguchi, Dept. of Water–Sci. and Engy., Nagoya Institute of Technology, Nagoya, Japan, SRNC–90, pp. 166–175 (Dec. 1990).

CAMP–ISIJ Study on Mechanism of Sticking of Ores (Development–4 of Fluidized BedPrereduction technology in a Melt Reduction Iron–Manufacturing Process) Iron & Steel Technology Center, Kobe Steel, Ltd., Kazuya Miyagawa, Amio Kamijo and Mikio Deguchi, vol. 2 (Dec. 1989)—118, 3 pgs.

CAMP–ISIJ Stable Fluidized Bed Reduction of Alumina–Coated Iron Ores Stable Fluidized Bed Reduction of Alumina Coating Iron Ores Nagoya Institute of Technology, Shoji Hayashi, Satoshi Sawai and Yoshiaki Iguchi, vol. 3 (Dec. 1990)—1082 pp. 1–3.

CAMP–ISIIJ Prevention of Sticking in Fluidized Bed Reduction of Various Particulate Iron Ores By Controlling a Partial Pressure Of Sulfur, Nagoya Institute of Technology, Shoji Hayashi, Sato vol. 3 (Dec. 1990)—125.

Shoji Hayashi and Yoshiaki Iguchi, Factors Affecting the Sticking of Fine Iron Ores during Fluidized Bed Reduction, *ISIJ International,* vol. 32 (Dec. 1992) pp. 962–971.

Kiichi Narita, Dentaro Kaneko and Yoshio Kimura, Study on Clustering and Its Prevention in the Shaft Furnace for Direct Reduction Process, *Transactions of The Iron and Steel Institute of Japan,* vol. 20, No. 4, pp. 228–235 (Dec. 1980).

J.F. Gransden and J.S. Sheasby, The sticking of iron ore during reduction by hydrogen in a fluidized bed, *Canadian Metallurgical Quarterly,* vol. 3 No. 4 (Dec. 1974), pp. 649–657.

Shoji Hayashi, Satoshi Sawai and Yoshiaki Iguchi, Influence of Coating Oxide and Sulfur Pressure on Sticking during Fluidized Bed Reduction of Iron Ores, *ISIJ International,* vol. 33, No. 10, (Dec. 1993), pp. 1078–1087.

Process for producing iron ore pellets having less susceptibility to sticking together, Translation of the Brazilian Patent Application PI 9300393–5 assigned to Companhia Vale Do Rio Doce (BR/MG), pp. 1–3. No Date Listed.

(List continued on next page.)

*Primary Examiner*—Scott Kastler

(57) ABSTRACT

A method for abating the incidence of cluster formation of reducible iron-containing material during the direct reduction of said material is disclosed. The method generally comprises contacting the reducible iron-containing material with a cluster-abating effective amount of a dispersion of a particulate material.

OTHER PUBLICATIONS

Production of Pellets at CVRD–Over 20 years and more than 200 million tons, Jose )P. Freire Jr. and Luiz A.B. de Mello presentaed at the *Latin American Iron and Steel Institute Congress, ILAFA,* (Dec. 1990), pp. J1–J12.

Kuh, Azar, Breid and Stueber, *Direct Reduced Iron Technology and Economics of Production and Use*, Dec. 1980, The Iron & Steel Society of AIME, pp. 3, 35, 36, 138.

Small, *Direct Reduction of Iron Ore*, Apr. 1981, Journal of Metals, pp. 67 to 75.

Kaneko, Kimura and Onoda, *Clustering Phenomena during Iron Oxide Reduction in Shaft Furnace*, Dec. 1978, pp. 1 to 10.

Kalla, Pttel and Steffen, *Development of Sponge Iron Production throughout the World*, Aug. 25, 1980, pp. 958 to 972.

Iron Making Division of the Iron and Steel Society, Inc., *53rd Ironmaking Conference Proceedings*, vol. 53, Mar. 20 to 23, 1994 (Table of Contents only).

*Midrex HBI*, Image View document, pp. 1 and 2, no date.

*Process Raw Materials, Utility Sources and Infrastructure*, www.orinoco–iron.com, pp. 1 and 2, no date.

Shephenson and Smailer, *Direct Reduced Iron Technology and Economics of Production and Used*, The Iron & Steel Society of AIME, Dec. 1980, pp. iii, vii, viii, ix, x.

New Steel, *Alternative Irons Defined and Explained*, Dec. 1998, pp. 1 to 10.

Griscom, *Expanding the Frontiers of Ironmaking*, Dec. 1997, pp. 3 to 5.

Mazurak, *The Five "W's" of Reduced Iron*, Skillings Mining Review, Dec. 1995, pp. 4 to 9.

Fruehan, *Future Iron and Steelmaking in the USA*, Scandinavian Journal of Metallurgy, Dec. 1999, pp. 77 to 85.

Schubert, Lungren and Steffen, *State of Development in the Direct Reduction and Smelting Reduction of Iron Ore*, Dec. 1996, pp. 159 and 70 to 79.

Feinman, J. Feinman and Associates, Mac, *Direct Reduced Iron, Technology and Economics of Production and Use*, The Iron and Steel Society, Dec. 1999.

*International Symposium on "Direct Reduction Technology"*, Cairo Egypt, Oct. 21 to 23, 2001.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 5 and 12 are cancelled.

Claims 1, 3, 4, 6, 7, 10, 11 and 14 are determined to be patentable as amended.

Claims 8, 9 and 13, dependent on an amended claim, are determined to be patentable.

New claims 15–17 and 18 are added and determined to be patentable.

1. A method [to lower] *of lowering* the incidence of clustering of reducible iron-containing agglomerates during the direct reduction of the iron *oxide* in said agglomerates *in a direct reduction furnace*, said method comprising [contacting] *coating* the agglomerates with a cluster-abating effective amount of a dispersion of [a] *an aluminum-containing* particulate material, said particulate material being substantially nonhardening in the presence of water, said [contacting] *coating* occurring prior to direct reduction.

3. The method of claim [2] *1* wherein the aluminum is provided in the form of bentonite.

4. The method of claim [2] *1* wherein the aluminum is provided in the form of bauxite.

6. The method of claim 1 wherein said [contacting] *coating* is accomplished by spraying.

7. The method of claim 1 wherein said [contacting] *coating* is accomplished by dipping.

10. The reducible iron-containing agglomerate*s* of claim 9 wherein the particulate material *coating* deposited [by dispersion contact] is about 0.01 to about 2 wt. % of the iron ore-containing agglomerate.

11. A method [to lower] *of lowering* the incidence of clustering of reducible iron-containing pellets during the direct reduction of said pellets *in a direct reduction furnace*, said method comprising [contacting] *coating* the pellets with a cluster-abating effective amount of a dispersion of [a] *an aluminum-containing* particulate material which is substantially nonhardening in the presence of water, said [contacting] *coating* occurring prior to direct reduction.

14. The method of claim 11 wherein said [contacting] *coating* is accomplished by a contacting method selected from dipping or spraying.

*15. The method of claim 1 wherein said agglomerates are in the form of pellets, briquettes or granules.*

*16. A method of lowering the incidence of clustering of reducible iron-containing lump ore during the direct reduction thereof in a direct reduction furnace, said method comprising coating said lump ore with a cluster-abating effective amount of a dispersion of an aluminum-containing particulate material said particulate material being substantially non-hardening in the presence of water prior to introducing said ore into the direct reduction furnace.*

*17. The method of claim 16 wherein said particulate material is selected from the group consisting of bentonite, bauxite and mixtures thereof.*

*18. The method of claim 17 wherein said coating is accomplished by a contacting method selected from dipping the lump ore in a dispersion of said bauxite, bentonite or mixtures thereof or spraying the lump ore with a dispersion of said bauxite, bentonite or mixtures thereof.*

* * * * *